US009492026B2

(12) United States Patent
Naeger

(10) Patent No.: US 9,492,026 B2
(45) Date of Patent: Nov. 15, 2016

(54) ADJUSTABLE OUTFIT HANGER

(71) Applicant: Barbara Sprague Naeger, Manchester, NH (US)

(72) Inventor: Barbara Sprague Naeger, Manchester, NH (US)

( * ) Notice: Subject to any disclaimer, the term of this patent is extended or adjusted under 35 U.S.C. 154(b) by 0 days.

(21) Appl. No.: 14/754,753

(22) Filed: Jun. 30, 2015

(65) Prior Publication Data

US 2016/0022075 A1 Jan. 28, 2016

Related U.S. Application Data

(60) Provisional application No. 61/999,278, filed on Jul. 22, 2014.

(51) Int. Cl.

| | |
|---|---|
| ***A47G 25/16*** | (2006.01) |
| ***A47G 25/48*** | (2006.01) |
| ***A47G 25/14*** | (2006.01) |
| ***A47G 25/06*** | (2006.01) |
| ***A47G 25/18*** | (2006.01) |

(52) U.S. Cl.

CPC ..... *A47G 25/16* (2013.01); *A47G 25/0685* (2013.01); *A47G 25/14* (2013.01); *A47G 25/186* (2013.01); *A47G 25/48* (2013.01)

(58) Field of Classification Search

CPC ..... A47G 25/16; A47G 25/48; A47G 25/02; A47G 25/0664; A47G 25/0671; A47G 25/0685; A47G 25/14; A47G 25/18; A47G 25/183; A47G 25/186; A47G 25/40; A47G 25/481–25/488; A47F 7/19

USPC ..... D06/315, 326, 328

See application file for complete search history.

(56) References Cited

U.S. PATENT DOCUMENTS

| | | | | | |
|---|---|---|---|---|---|
| 1,422,782 | A * | 7/1922 | Rattan | A47G 25/18 | 223/89 |
| 1,982,166 | A * | 11/1934 | Hultquist | A47G 25/16 | 211/113 |
| 2,506,510 | A * | 5/1950 | Longwell | A47G 25/18 | 223/91 |
| 2,672,989 | A * | 3/1954 | Creveling | A47G 25/18 | 211/113 |
| 2,710,638 | A * | 6/1955 | Ford | A45C 3/00 | 383/121 |
| 4,097,359 | A * | 6/1978 | Davitz | C25D 17/08 | 118/500 |
| 4,253,577 | A * | 3/1981 | Macfarlane | A47G 25/18 | 211/118 |
| 9,060,635 | B1 * | 6/2015 | Neal | A47G 25/70 | |
| 2007/0142814 | A1 * | 6/2007 | Akselrod | A45C 3/004 | 604/387 |
| 2009/0224009 | A1 * | 9/2009 | Lubow | A47G 25/16 | 223/91 |

OTHER PUBLICATIONS

[unknown Internet source], Prior Art Clothes Hangers (last visited Jan. 8, 2015) (admitted prior art).

* cited by examiner

*Primary Examiner* — Ismael Izaguirre

(74) *Attorney, Agent, or Firm* — Mesmer & Deleault PLLC

(57) ABSTRACT

An outfit hanger has a first hanger portion and a second hanger portion connected to the first hanger portion in a spaced-apart vertical relation by connector members extending between the hanger portions. Each hanger portion has a panel with a support member attached along the top portion. Clips are adjustably attached to the support member. A hanger hook is attached to and extends up from the first support member. A reinforcement strip is secured along the bottom portion of the first panel and defines openings through which the connector members are secured. The connector members have a length of material that extends to and connect through corresponding openings in the support member on the second hanger portion. The connector members, the first hanger portion, and the second hanger portion define and frame an open region.

13 Claims, 5 Drawing Sheets

ADJUSTABLE OUTFIT HANGER

BACKGROUND OF THE INVENTION

1. Field of the Invention

The present invention relates generally to clothing storage and hanging apparatuses and more particularly to hangers for clothing and accessories.

2. Description of the Prior Art

Traditionally, clothes hangers are used to hang portions of a garment. Some clothes hangers are made of a length of wire or plastic that is bent or formed into the general shape of an isosceles triangle with an obtuse vertex angle and including a hook extending from a point near the vertex. The triangular shape that is useful for hanging shirts or jackets by inserting corners of the triangle into sleeves of the garment with legs of the triangle extending gently upward along the shoulders of the garment. The horizontal bar along the base of the triangular shape is useful for hanging pants. In some embodiments, hanger clips are slidably mounted along the horizontal bar of the hanger. When so equipped, pants may be clipped at the waist to the hanger clips. Whether pants are folded over the horizontal bar or clipped to hanger clips, a garment on the frame of the hanger generally obscures the pants.

In other embodiments of a clothes hanger, legs of the triangular clothes hangers include notches for dress straps and shoulder straps of tank tops and other garments that do not have shoulders to engage the side corners of the hanger.

For storage, garment bag organizers are useful for hanging garments and accessories together. In one embodiment, the organizer is a clear plastic garment bag sized to enclose a garment on a hanger. Garments are hung on a traditional clothes hanger and then inserted into the bag with the hanger hook extending through an opening in the top of the garment bag. As such, the hanger hooks of hangers inside the bag are used for hanging the garment bag and its contents on a door, hook, or closet rod. The lower portion of the garment bag may include pockets to store socks, shoes, and accessories.

Another type of outfit storage is a garment bag for travel. Such a garment bag is typically made of flexible material and can fold on itself to a size suitable for travel. The garment bag has a single hook or connector inside the bag's compartment for hooking hangers. Hanging garments are placed on a hanger that hooks to the connector. Pockets may be attached along the inside corners of the garment bag compartment or to the outside surface of the garment bag. Using clothes hangers, one may store multiple outfits in the garment bag. The bag itself may hang from a door using a separate hook attached to the bag's frame. Alternately, the garment bag may be laid out on a bed or table.

SUMMARY OF THE INVENTION

Unfortunately, prior-art clothes hangers and garment bags lack features needed for organizing a complete outfit. Even though some prior-art clothes hangers include notches or hooks, these clothes hangers do not allow the user to view an entire outfit including accessories. Significantly, prior-art clothes hangers are not configured to store socks, except by the horizontal bar where the socks would be hidden from view. Traditional clothes hangers also lack separate hooks for jewelry and belts.

Garment bags for storage and travel also have deficiencies. When the garment bag is sized for traveling, the vertical length of the bag does not allow the user to view an entire outfit. Also, since all garments are hung from a single connector at the top of the bag, pants cannot extend sufficiently below shirts or jackets for viewing due to the lower limit of the bag. Even if the garment bag has a longer length, one cannot sufficiently see an entire outfit because all garments hang from the one hook at the top of the bag.

Garment bag organizers have deficiencies similar to garment bags for travel. For example, garments are hung on clothes hangers that extend through the top of the garment bag. Therefore, like the travel garment bag, the organizer has all garments hanging from the same location. Also, the length of the bag often precludes pants from hanging sufficiently below other hanging garments for the user to be able to see and plan an entire outfit. Further, pockets on the front panel of garment bag organizers are positioned on the lower half of the bag so that the user can see the hanging garment, such as a shirt or jacket. However, when objects are placed in these pockets, the lower portion of the garment is hidden from view. Therefore, the user cannot see a full outfit that includes a shirt or top, pants, socks, accessories, and the like when using prior art garment bags and organizers.

Prior-art clothes hangers and garment bags also lack the ability to adjust to desired sizes for the upper and lower garments. Although some hangers have clips that slide, the clips are located only on the horizontal bar of the hanger.

Therefore, what is needed is an improved outfit hanger that allows the user to hang and view an entire outfit. What is also needed is an outfit hanger that facilitates planning and organizing an outfit more effectively than prior-art hangers. What is further needed is an adjustable outfit hanger that is configured for use with outfits of various sizes and configurations and enables the user to also hang jewelry, belts, or other accessories.

The present invention achieves these and other objects by providing an adjustable outfit hanger that allows complete outfits to be hung and displayed in their entirety. Embodiments of the outfit hangers enable the user to see and plan an entire outfit with accessories. Outfit hangers of the present invention also allow the user to assemble and store outfits in advance, thereby reducing the stress of selecting an outfit at the last minute. Outfit hangers of the present invention greatly benefit people who are blind, color blind, or struggle physically to assemble an outfit.

Yet another benefit of outfit hangers of the present invention is that certain costumes and outfits need to be ready for use and should be stored with all components of the outfit in one convenient location. Outfits of this type include outfits for religious ceremonies, karate, ballet, or team sports. Furthermore, the outfit hanger of the present invention allows undergarments to be stored with the outer garments. This especially helps the elderly and their care takers so forgetful people do not forget to wear their undergarments.

In one embodiment, an outfit hanger includes a first hanger portion and a second hanger portion. When the outfit hanger hangs from a hanger hook, the second hanger portion is aligned with and positioned vertically below the first hanger portion. The first hanger portion has a first panel with a first width, a first top portion and a first bottom portion. The first panel is rectangular in some embodiments. A first support member is attached along the first top portion of the first panel. One or more clips are slidably mounted to the first support member. A hanger hook is connected to and extends from a middle portion of the first support member. A reinforcement strip is secured along the bottom portion of the first panel and defines a first left connector opening and a first right connector opening.

The second hanger portion is substantially coplanar with and spaced apart from the first hanger portion. The second hanger portion has a second panel with a second width, a second top portion and a second bottom portion. In some embodiments, the second panel is made of fabric and has a rectangular shape. A second support member is attached along the second top portion of the second panel, where the second support member defines left and right connector openings that are aligned with the respective left and right connector openings of the first hanger portion. One or more clips are slidably mounted to the second support member. At least one second-panel pocket is attached to the second fabric panel. In some embodiments, the second-panel pocket is removable. A left connector member extends between and connects the first hanger portion to the second hanger portion, where the left connector member has a length of material that connects through the left connector openings. Similarly, a right connector member extends between and connects the first hanger portion to the second hanger portion, where the right connector member has a length of material that connects through the right connector openings. The first bottom portion, the second top portion, the left connector member, and the right connector member define and frame an open region between the first hanger portion and the second hanger portion.

In another embodiment, the outfit hanger includes a pocket attached to the first panel. In some embodiments, the pocket is removable.

In some embodiments, one or more of the clips includes a hook.

In another embodiment, a hook member has a hook body portion secured to the first support member and a hook portion that extends below the first support member along the first panel. The hanger hook is connected to the hook body portion of the hook member. In some embodiments, the position of the hanger hook is adjustable along the first support member.

In another embodiment, a second hook member is attached to the second support member. The second hook member has a hook body portion secured to the second support member and a hook portion that extends below the second clip-support member along the second panel.

In another embodiment, the outfit hanger has a reinforcement strip secured along the second bottom portion of the second panel.

In another embodiment, a second-panel pocket includes two or more pocket compartments that together extend substantially across the second width of the second panel.

In another embodiment, the left connector member and the right connector member are adjustable, thereby enabling the user to adjust the size of the open region.

In another embodiment, the first panel and the second panel are made of a flexible material, such as fabric or leather.

In another embodiment, the left and right connector members are made of nylon webbing, leather, metal, chain, plastic, or fabric.

DETAILED DESCRIPTION

Figure 1:
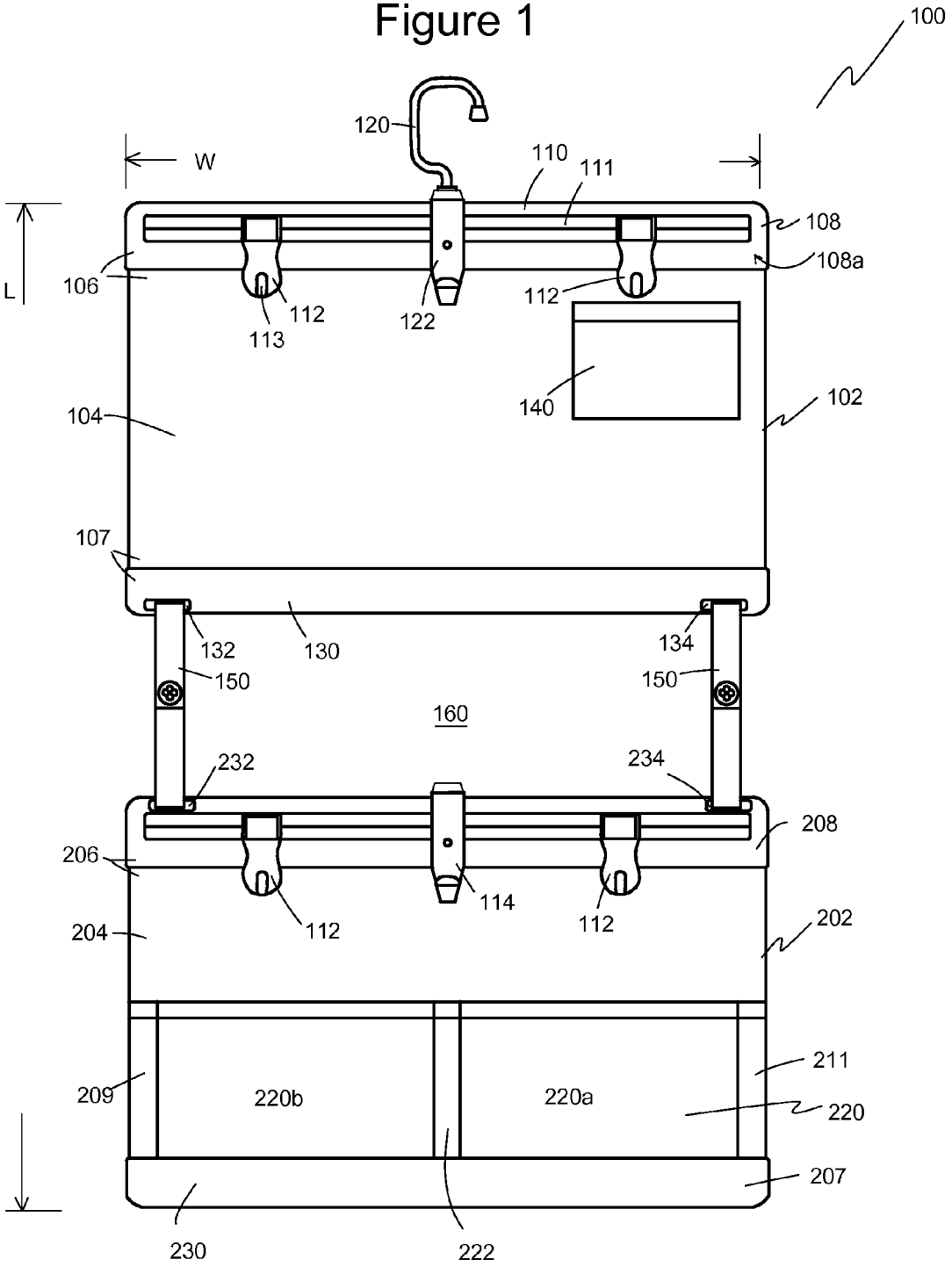
FIG. 1 is a front elevational view of one embodiment of an outfit hanger of the present invention.

Exemplary embodiments of the present invention are illustrated in FIGS. 1-5. FIG. 1 shows a front elevational view of one embodiment of an outfit hanger 100 that includes a first hanger portion 102 and a second hanger portion 202 suspended from and vertically spaced apart from first hanger portion 102.

First hanger portion 102 has a first panel 104. In one embodiment, first panel 104 is substantially rectangular with straight edges and slightly rounded corners. First panel 104 has a first top portion 106 and a first bottom portion 107. Other regular and irregular shapes are acceptable for first panel 104, such as square, oval, or trapezoidal. In some embodiments, first panel 104 is made of fabric of natural and/or synthetic fibers, such as cotton, nylon, polyester, or other fabrics. First panel 104 may also be made of leather, plastic, polycarbonate, or other rigid or flexible materials.

Figure 2:
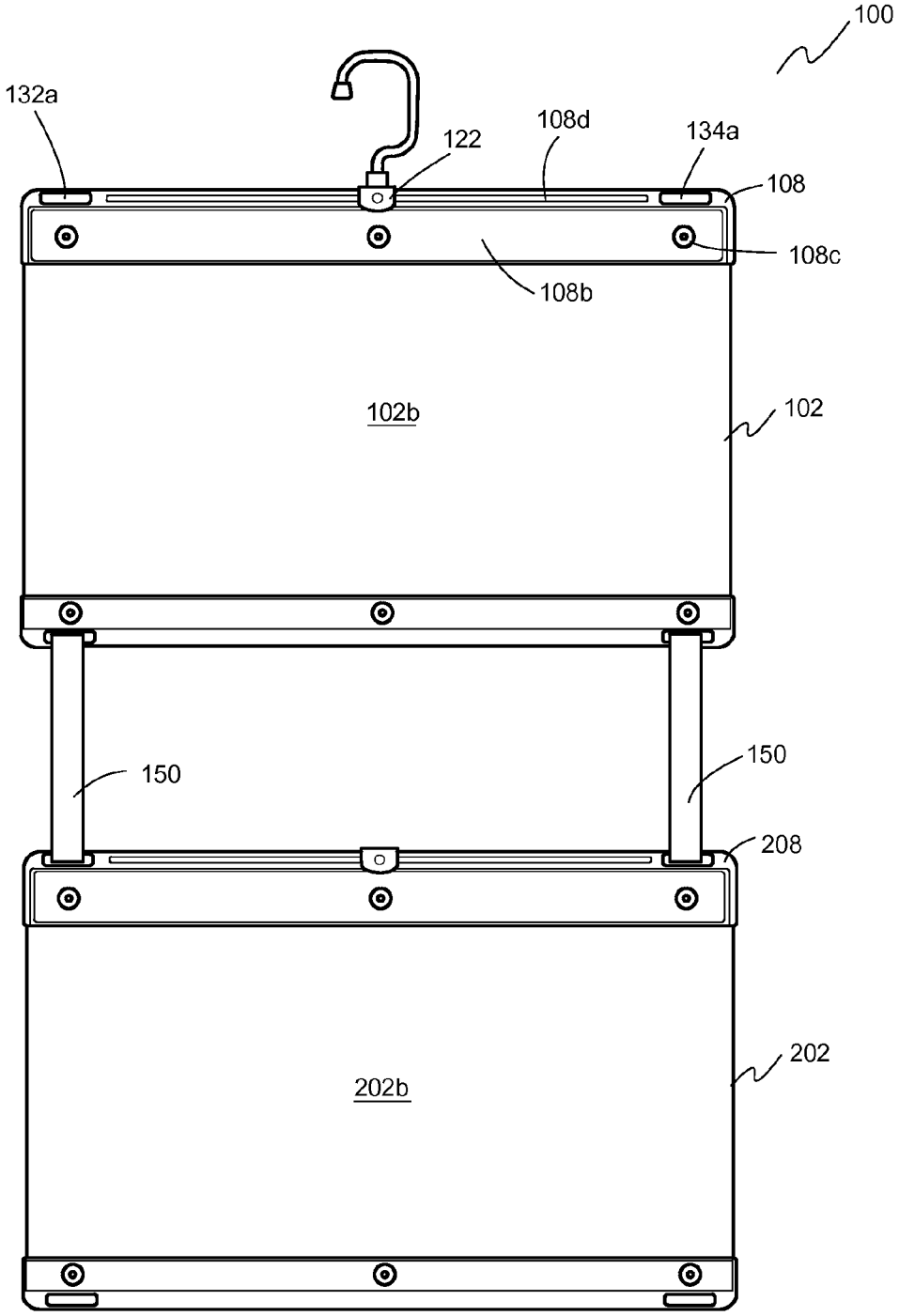
FIG. 2 is a rear elevational view of the outfit hanger of FIG. 1

An elongated first support member 108 is fixedly attached along first top portion 106. Preferably, first support member 108 has a shape corresponding to the shape of first top portion 106. Thus, when first panel 104 is rectangular, first support member 108 preferably is a straight strip or bar that extends substantially along the width W of first top portion 106. First support member 108 is made of rigid materials, such as hard plastic, metal, wood, or similar materials having sufficient strength to and rigidity to support first panel 104 and second hanger portion 202 hanging below it. In some embodiments, first support member 108 includes only a front portion **108*a* (shown in FIG. 1); in other embodiments, first support member 108 includes both front portion 108*a* and a rear portion 108*b*, which is shown in FIG. 2** and discussed below.

In one embodiment, first support member 108 includes one or more horizontal ridges 110 and/or valleys 111 that extend along a face of front portion **108*a*. Ridges 110 and/or valleys 111 are configured to receive and mate with one or more clips 112 attached thereto. For example, clip 112 is a pinch clip or spring clip that slidably attaches to first support member 108 with a feature on its back face that engages ridge(s) 110 and/or valley(s) 111 on first support member 108. In other embodiments, first support member 108 includes a length of hook-and-loop connector such as those sold under the trademark Velcro®, a channel, a protrusion, or other connection structure that enables adjustable or removable attachment of clip(s) 112**.

Clip 112 can be a pinch clip, an alligator clip, a spring clip, a hanger clip, or other variety of clip. Typically, clip 112 requires the user to squeeze together handles at one end of the clip to create an opening between jaws at the opposite end. Upon releasing the handles of the clip, the jaws close in response to a biasing mechanism such as, for example, a spring or other similar structure. Clip(s) 112 may also be a three-prong clip having two outer prongs and an inner prong positioned between and substantially parallel to the outer prongs. Similar to a paperclip, clothing may held in the three-prong clip between two outside prongs and the middle prong. Other varieties of clothing clips are also acceptable. In some embodiments, clip(s) 112 include a hook 113 for hanging belts, necklaces, lanyards, or other objects.

A hanger hook 120 is attached to and extends vertically above first hanger portion 102. Traditionally, hanger hook 120 is a length of material curved to complete about 270 degrees of a circle. Hanger hook 120 may be metal, wire, plastic, or any other material providing sufficient strength and rigidity to support outfit hanger 100 and any other accessories thereon. In one embodiment, hanger hook 120 is attached to first panel 104 and/or first support member 108 and positioned near the middle of first top portion 106. In one embodiment, for example, hanger hook 120 has a hook base portion 122 that is secured to first hanger portion 102 by fasteners (e.g., rivets, stitching, buttons, etc.) adhesive, or threaded engagement with first support member 108.

In another embodiment, hook base portion 122 slidably engages first support member 108 and is slidable along first support member 108 similar to as described above for clip(s) 112. Being able to slide along first support member 108 allows the user to move the hanger hook 120 to the center of gravity along first support member 108, such as when heavy objects on one side of outfit hanger 100 cause it to be unbalanced. In yet another embodiment, hook bottom portion 122 is a receptacle, block, or other structure that is fixedly attached to, made monolithically with, or otherwise secured to first support member 108. In such an embodiment, hanger hook 120 is secured to hook base portion 122 by threaded engagement, snap fit, mechanical attachment, or other methods of attachment. In some embodiments, hanger hook 120 freely rotates with respect to hook base portion 122. Hanger hook 120 is configured to support outfit hanger 100 by hooking over a closet rod, door, partition, coat hook, or other object.

First panel 104 optionally includes one or more pockets 140. In one embodiment, pocket 140 is a rectangular piece of material secured to first panel 104 along right, left, and bottom sides. In other embodiments, pocket 140 is a free-standing pocket or pouch that is removably attached to first panel 104 (shown in FIG. 4). For example, pocket 140 is made of a first pocket piece 142 and a second pocket piece 144 of fabric that are stitched together along right, left, and bottom sides and including one or more pocket fasteners 146 to secure pocket 140 to first panel 104. For example, pocket fastener 146 may be first fastener part 146*a* of a button, snap, or hook-and-loop fastener secured to second pocket piece 144, where a corresponding second fastener part 146*b* of pocket fastener 146 is secured to first panel 104 for mating engagement with first fastener part 146*a*. Pocket(s) 140 are useful for storing accessories, such as jewelry, makeup, lanyards, name tags, neck tie, tie clip, or other item.

An optional reinforcement strip 130 is secured along first bottom portion 107 of first panel 104. Reinforcement strip 130 provides additional strength and, in some cases, rigidity to first bottom portion 107 of first hanger portion 102. In one embodiment, reinforcement strip 130 is made of plastic, metal, cloth, leather, or other material. In one embodiment, reinforcement strip 130 folds in a U-shaped channel around first bottom portion 107. Portions of the U-shaped channel may be attached to each other using mating features, mechanical fasteners, or the like. Portions of the U-shape reinforcement strip 130 may also be secured to each other and to first bottom portion 107 by stitching or adhesive. In another embodiment, reinforcement strip 130 overlays first bottom portion 107 and is secured thereto by stitching, adhesive, fasteners, or other method. In some embodiments, reinforcement strip 130 overlaps and extends vertically below first bottom portion 107.

Reinforcement strip includes a first left connector opening 132 and a first right connector opening 134 therethrough. In some embodiments, corresponding openings (not shown) to first left and right connector openings 132, 134 also extend through first bottom portion 107, depending on the size and placement of reinforcement strip 130 relative to first bottom portion 107. Left and right connector openings 132, 134 are each sized to receive a connector member 150, such as a strap, chain, cord, hook, or other length of material that extends between first hanger portion 102 and second hanger portion 202. For example, connector members 150 are straps made of woven nylon, cloth, or leather that loop through first left and right connector openings 132, 134 and through second support member 208. Optionally, additional connector members 150 extend at other locations along reinforcement strip 130 between first hanger portion 102 and second hanger portion 202 for added strength or to define smaller openings between first and second hanger portions 102, 202.

Second hanger portion 202 is attached to first hanger portion 102 by connector members 150 extending therebetween. When outfit hanger 100 is hanging by hanger hook 120, second hanger portion 202 is positioned vertically below first hanger portion 102. Second portion 202 is typically similar in construction, size, and shape to the first hanger portion 102, but may differ in these qualities as well as in the presence or absence of other features. Connector members 150 include left connector member 150*a* and right connector member 150*b*, which may be of various predefined lengths. In one embodiment, left connector member 150*a* and right connector member 150*b* are adjustable. As such, the total vertical length L of outfit hanger 100 may be adjusted to suit clothing of different lengths, for hanging outfit hanger 100 in different sizes of closets or hanging areas, and for adjusting the visual appearance of the outfit based on the user's height and the clothing selected.

In some embodiments, connector members 150 are pliable so that first hanger portion 102 and second hanger portion 202 may be folded together for storage. In other embodiments, connector members 150 include a hinge (not shown) that similarly allows folding second hanger portion 202 against first hanger portion 102.

Like first hanger portion 102 discussed above, second hanger portion 202 has a second panel 204 and a second support member 208 secured along second top portion 206 with features to slidably engage one or more clips 112. Second support member 208 defines second left connector opening 232 and second right connector opening 234, which are each sized similar to and located to align with first left connector opening 132 and first right connector opening 134, respectively. First bottom portion 107 of first hanger portion 102, connector members 150, and second top portion 206 of second hanger portion 202 frame an open region 160 between first hanger portion 102 and second hanger portion 202.

In one embodiment, a center clip 214 occupies the corresponding location on second support member 208 as occupied by hook base portion 122 of first hanger portion 102. Optionally, center clip 214 is configured to add a second hanger hook 220 (not shown). Therefore, if the user desires, second hanger portion 202 may be disconnected from first hanger portion 102 and used separately from first hanger portion 102 to hang garments, accessories, and the like from a rod or other object. In some embodiments, clip(s) 112 and center clip 214 are adjustably connected to second support member 208 to accommodate garments of different sizes. Additionally, the user may adjust the position of one or more clips 112 for improved balance of outfit hanger 100 if it becomes tilted or unbalanced due to heavy objects on one or more clips 112.

Second hanger portion 202 includes one or more storage pocket 220. In one embodiment, storage pocket 220 is a piece of fabric or other flexible material secured to second panel 204 along second bottom portion 207, second left edge 209, and second right edge 211. In one embodiment, storage pocket 220 comprises two or more pocket compartments 220*a*, 220*b* separated by a pocket divider 222. Pocket divider 222 may be an insert or panel within storage pocket 220 or may be a region along which storage pocket 220 is additionally secured to second panel 204, such as by stitching or other fastening mechanism. Storage pocket 220 as a whole, and any pocket compartments 220*a*, 220*b* individually, is useful to store shoes, undergarments, socks, toiletries, or other items not typically hung on a hanger, but that are still part of a complete outfit.

Similar to first hanger portion 102, some embodiments of second hanger portion 202 include a second reinforcement strip 230 is secured along second bottom portion 207 to reinforce storage pocket 220 and/or for optional attachment of an additional hanger portion. Second reinforcement strip 230 also has the advantage in some embodiments of maintaining the shape of second hanger portion 202, such as when bulky or heavy objects are stored and when second panel 204 is made of fabric or other pliable material. Optionally, second reinforcement strip 230 is configured to attach to first support member 108 when second hanger portion 202 is folded to overlap first hanger portion 102 for storage. For example, second reinforcement strip 230 is received in clips 112 or engages hooks 113 of first support member.

Referring now to FIG. 2, a rear elevational view illustrates outfit hanger 100 of FIG. 1 showing first rear face 102*b* of first hanger portion 102 and second rear face 202*b* of second hanger portion 202. Rear portion 108*b* of first support member 108 extends across first top portion 106 of first hanger portion 102 and connects to front portion 108*a* using connectors 108*c*. Connectors 108*c* may be fasteners (e.g., screws, rivets), mating snap-fit structures (e.g., post and receptacle, snap buttons, etc.), adhesive, stitching, or other structure that attaches rear portion 108*b* to front portion 108*a* of first support member 108. In some embodiments, connectors 108*c* extend through first panel 104. In other embodiments, front and rear portions 108*a*, 108*b* of first support member 108 clamp, squeeze, frictionally engage, or otherwise grip first panel 104 to securely retain it. In yet other embodiments, first top portion 106 terminates with a rolled or thickened edge (not shown) that is retained in a gap between front and rear portions 108*a*, 108*b* of first support member 108. For example, when first panel 104 is made of fabric, first top portion 106 is rolled around a dowel or strip that is retained within first support member 108.

Rear portion 108*b* of first support member 108 defines a recess 108*d* for engaging hook base portion 122 and other optional attachments. In one embodiment, recess 108*d* is a horizontal slot, groove, or channel, but recess 108 may also have a round, rectangular, or other shape. Optionally, rear portion 108*b* defines connector openings 132*a* and 134*a* configured to attach to additional connector members 150*a* (not shown) or to other attachments.

Optionally, rear face 102*b* includes one or more pocket(s) 140, storage pocket(s) 220, clips 112, or other features discussed above for front face 102*a*.

Second support member 208 may be constructed similar to first support member 208. Accordingly, features discussed above for first support member 108 also apply to second support member 208.

Figure 3:
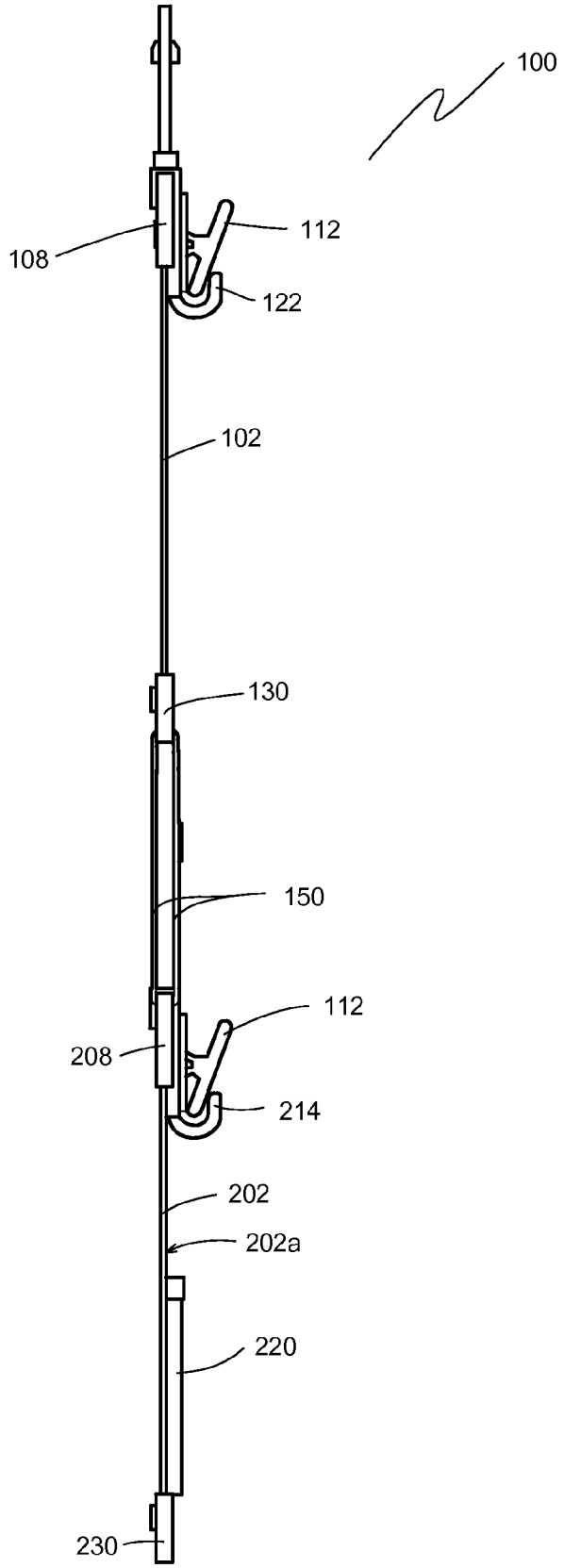
FIG. 3 is a side elevational view of the outfit hanger of FIG. 1

Referring now to FIG. 3 there is shown a side elevational view of one embodiment of outfit hanger 100. FIG. 3 illustrates the slim profile of outfit hanger 100. Connector members 150 define a closed loop that extends through first and second hanger portions 102, 202. Clips 112 are illustrated as spring clips. Storage pocket 220 slightly protrudes from second hanger portion 202 since it is secured to the front face 202*a* of second hanger portion 202. The hook portion 122*a* of hook 122 is visible behind clip 112. A hook of center clip 214 is also visible behind clip 112.

Figure 4:
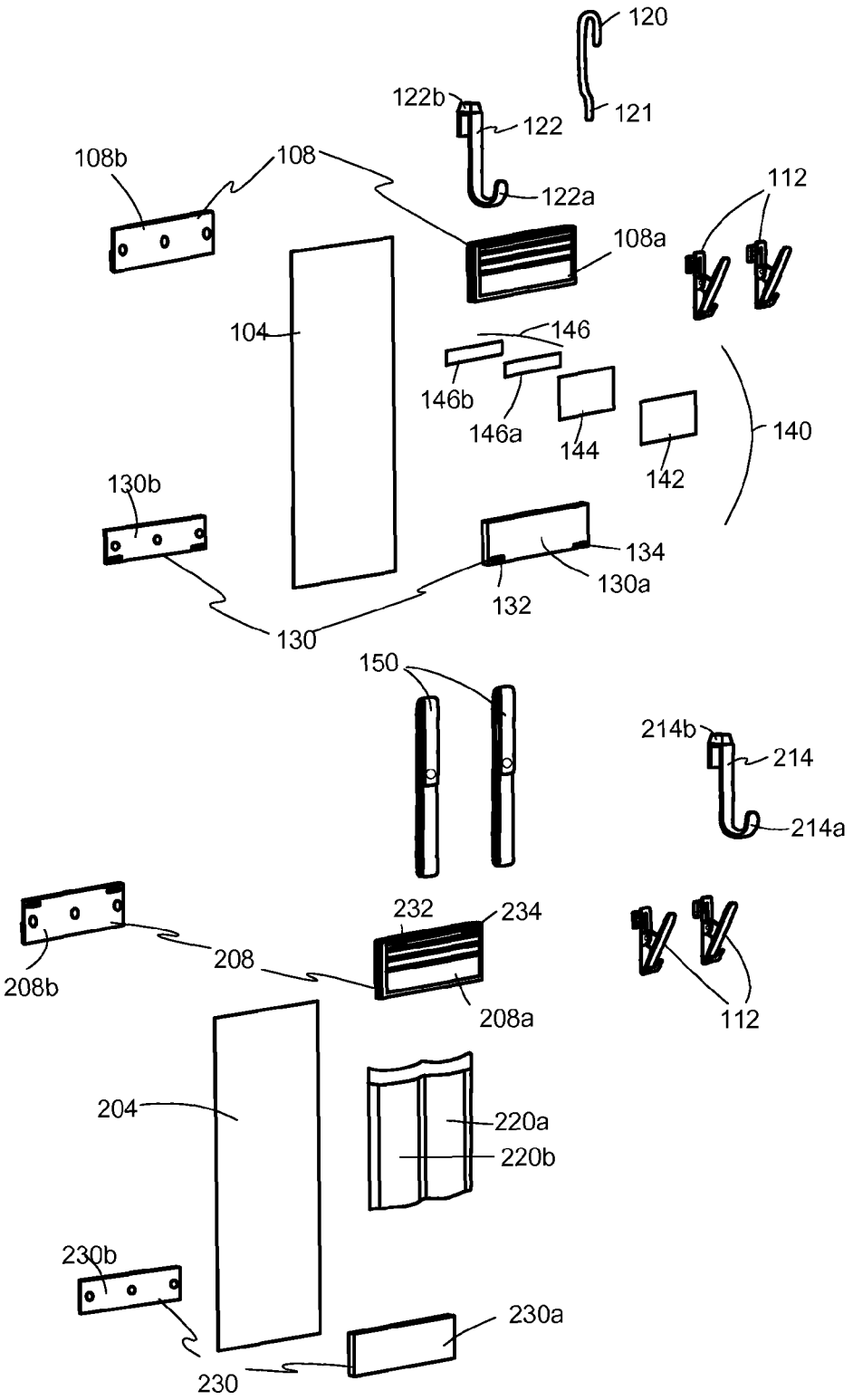
FIG. 4 is an exploded, perspective view of the outfit hanger of FIG. 1 showing components the assembly.

Referring now to FIG. 4, an exploded perspective view shows components of one embodiment of outfit hanger 100. Hanger hook 120 has a hook stem 121 that is securely received in hook base portion 122. Base portion 122 has a J-shaped hook 122*a* at a lower end and a rectangular hook 122*b* at the upper end that overlaps first support member 108. A fastener (not shown) extending through rectangular hook 122*b* into recess 108*d* in rear portion 108*b* of first support member 108 secures hook base portion 122 to first support member 108. In other embodiments, a tab or protrusion (not shown) on rectangular hook 122*b* engages recess 108*d* to secure hook base portion 122 to first support member 108.

First support member 108 includes front portion 108*a* and rear portion 108*b* that connect together and engage first top portion 106 of first panel 104. Clips 112 slidably attach to front portion 108*a* of first support member 108.

Pocket 140 includes first pocket piece 142 and second pocket piece 144 that are secured together along three sides (e.g., by stitching) to define the pocket compartment. First fastener part 146*a* is secured to pocket 140 and engages second fastener part 146*b* that is secured to first panel 104.

Reinforcement strip 130 includes front part 130*a* and rear part 130*b*. Like first support member, front part 130*a* and rear part 130*b* of reinforcement strip 130 attach to each other while engaging first bottom portion 107 of first panel 104. Connector members 150 have predefined lengths that extend through first connector openings 132, 134 of reinforcement strip 130 and extend to connect through second connector openings 232, 234 on second support member 208. Similar to first support member 108, second support member 208 has front part 208*a* and rear part 208*b* that attach together and engage second panel 204. Similar to hook base portion 122, center clip 214 has a rectangular hook 214*b* and a J-shaped hook 214*a*, where rectangular hook 214 overlaps and engages second support member 208.

Storage pocket 220 is a panel of fabric or other flexible material that is secured to second panel 204 along three sides and vertically along a middle region to define first and second pocket compartments 220*a*, 220*b*. Like reinforcement strip 130, second reinforcement strip 230 includes front part 230*a* and 230*b* that connect together and engage second panel 204. In one embodiment, storage pocket 220 is removably attached to second panel 204, such as by buttons or other connector.

Figure 5:
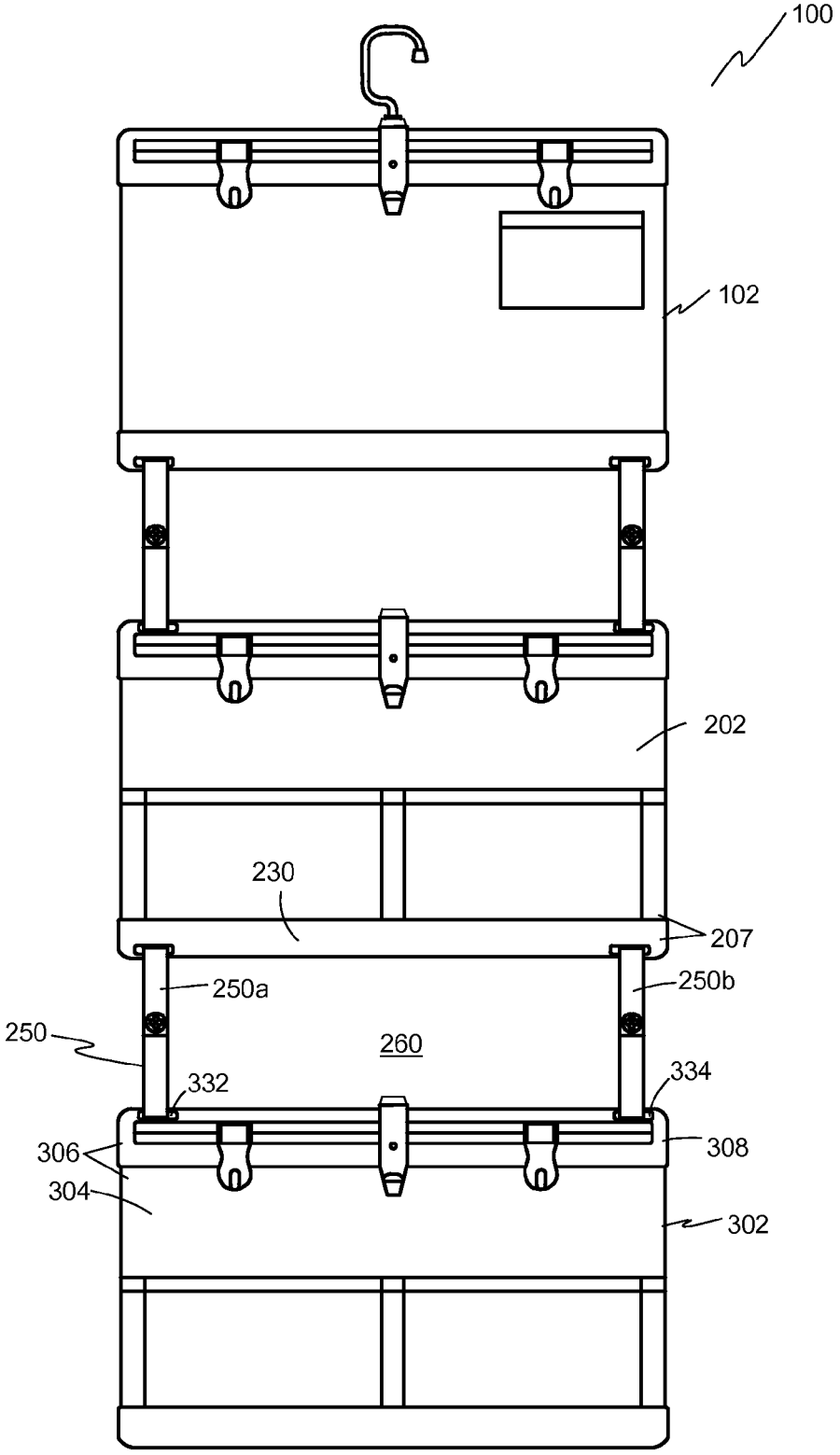
FIG. 5 is a front elevational view of another embodiment of an outfit hanger of the present invention.

Referring now to FIG. 5, another embodiment of outfit hanger 100 is illustrated in a front elevational view. In this embodiment, outfit hanger 100 includes first hanger portion 102, second hanger portion 202, and an additional or third hanger portion 302. Similar to as discussed above for first and second hanger portions 102, 202, additional hanger portion 302 is spaced apart from and connected to second hanger portion 202 by second left connector member 250*a* and second right connector member 250*b*. An additional support member 308 is attached along the top portion 306 of additional panel 304. Additional left connector opening 332 and additional right connector opening 334 are aligned with first left connector opening 232 and first right connector opening 234, respectively. Second bottom portion 207 (which includes second reinforcement strip 230), connector members 250, and additional support member 308 frame an additional open region 260 between the second hanger portion 202 and additional hanger portion 302.

In use, outfit hanger 100 can be used to hang, plan, and view a complete outfit that includes a shirt, pants, belt, socks, necktie, shoes, jewelry and other accessories. Pants may be folded over second support member 208 or clipped to clips 112 on second support member 208, depending on the length of a shirt above and the available space below. Due to the open space 160 between first hanger portion 102 and second hanger portion 202, the entire outfit is visible to the user. Additionally, open space 160 can be adjusted by lengthening or shortening connector members 150. In this way, the user can customize outfit hanger 100 to display an outfit as determined by one's individual taste or needs.

Outfit hanger facilitates wardrobe planning for travelers, for people who must don a particular complete outfit on short notice, for people who are color blind, and for people who are unable to coordinate or select an outfit for themselves. Having a complete outfit hanging on a single outfit hanger 100 and ready to wear, including shoes, accessories, and jewelry, allows the user to change into the outfit with short notice without the stress of finding and coordinating components that work well together.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. An outfit hanger comprising:

a first hanger portion comprising:

a first panel having a first width, a first top portion and a first bottom portion;

a first support member attached along the first top portion of the first panel;

a plurality of first clips slidably mounted on the first support member;

a hanger hook attached to and extending from a middle portion of the first support member;

a reinforcement strip secured along the bottom portion of the first panel and defining a first left connector opening and a first right connector opening; and a second hanger portion substantially coplanar with and spaced apart from the first hanger portion, the second hanger portion comprising:

a second panel having a second width, a second top portion and a second bottom portion;

a second support member attached along the second top portion of the second panel, wherein the second support member includes a second left connector opening aligned with the first left connector opening and a second right connector opening aligned with the first right connector opening; and a plurality of second clips slidably mounted to the second support member;

a left connector member having a length of material extending between and connecting the first hanger portion to the second hanger portion, wherein the left connector member connects through the first left connector opening and the second left connector opening; and a right connector member having a length of material extending between and connecting the first hanger portion to the second hanger portion, wherein the right connector member connects through the first right connector opening and the second right connector opening;

wherein the first bottom portion, the second top portion, the left connector member, and the right connector member define and frame an open region between the first hanger portion and the second hanger portion; and wherein when the outfit hanger hangs from the hanger hook, the second hanger portion is aligned with and positioned vertically below the first hanger portion.

2. The outfit hanger of claim 1 further comprising a pocket attached to the first panel.

3. The outfit hanger of claim 2, wherein the pocket is removably attached to the first panel.

4. The outfit hanger of claim 1, wherein at least one of the plurality of first clips includes a hook.

5. The outfit hanger of claim 1 further comprising a first hook member secured to the first support member, the first hook member having a hook body portion secured to the first support member and a hook portion that extends below the first support member along the first panel, wherein the hanger hook is connected to the hook body portion of the hook member.

6. The outfit hanger of claim 1, further comprising a second hook member on the second support member, the second hook member having a hook body portion secured to the second support member and a hook portion that extends below the second clip-support member along the second panel.

7. The outfit hanger of claim 1 further comprising a reinforcement strip secured along the second bottom portion of the second panel.

8. The outfit hanger of claim 1, further comprising at least one second-panel pocket at least one second-panel pocket attached to the second panel and including at least one compartment.

9. The outfit hanger of claim 1, wherein the left connector member and the right connector member are adjustable, thereby enabling the user to adjust the size of the open region.

10. The outfit hanger of claim 1, wherein the left connector member and the right connector member comprise a material selected from the group consisting of nylon webbing, leather, metal, chain, plastic, and fabric.

11. The outfit hanger of claim 1, wherein the first panel and the second panel are made of a flexible material.

12. The outfit hanger of claim 1, wherein the hanger hook has an adjustable position on the first support member.

13. The outfit hanger of claim 1 further comprising:

an additional hanger portion substantially coplanar with and spaced apart from the second hanger portion, the additional hanger portion comprising:

a panel with an additional panel top portion and an additional panel bottom portion;

an additional support member attached along the additional panel top portion, wherein the additional support member defines an additional left connector opening aligned with the first left connector opening and an additional right connector opening aligned with the first right connector opening;

a second left connector member having a length of material extending between and connecting the additional hanger portion to the second hanger portion; and a second right connector member having a length of material extending between and connecting the additional hanger portion to the second hanger portion;

wherein the second bottom portion, top portion of the additional panel, the second left connector member, and the second right connector member define and frame an additional open region between the second hanger portion and the additional hanger portion; and wherein when the outfit hanger hangs from the hanger hook, the additional hanger portion is aligned with and positioned vertically below the second hanger portion.

* * * * *